United States Patent [19]

Lewis et al.

[11] 4,303,181

[45] Dec. 1, 1981

[54] CONTINUOUS CASTER FEED TIP

[75] Inventors: William R. Lewis, Riverside; Dennis M. Smith, Crestline; Wendell G. Jenness, Riverside, all of Calif.

[73] Assignee: Hunter Engineering Company, Riverside, Calif.

[21] Appl. No.: 957,185

[22] Filed: Nov. 2, 1978

[51] Int. Cl.[3] ..... B22D 11/06

[52] U.S. Cl. ..... 222/591; 164/437; 428/171; 428/702

[58] Field of Search ..... 164/87, 437, 427–434; 428/170, 171, 538, 539; 264/109, 120, 122, 119, 294, 296, DIG. 66; 222/591; 425/394, 398

[56] References Cited

U.S. PATENT DOCUMENTS

| | | | |
|---|---|---|---|
| 2,767,436 | 10/1956 | Noland et al. | 264/DIG. 66 |
| 2,790,216 | 4/1957 | Hunter | 164/428 X |
| 3,092,247 | 6/1963 | Woodruff | 206/46 |
| 3,430,683 | 3/1969 | Hood | 164/428 |
| 4,003,758 | 1/1977 | Palmer et al. | 264/119 |
| 4,054,173 | 10/1977 | Hickam | 164/428 |
| 4,078,030 | 3/1978 | Munk et al. | 264/120 X |
| 4,213,928 | 7/1980 | Casselbrant | 264/120 X |
| 4,232,804 | 11/1980 | Lewis et al. | 164/428 X |

FOREIGN PATENT DOCUMENTS

| | | | |
|---|---|---|---|
| 912847 | 12/1962 | United Kingdom | 264/120 |

*Primary Examiner*—Robert D. Baldwin

*Attorney, Agent, or Firm*—Christie, Parker & Hale

[57] ABSTRACT

A molten metal feed tip for a continuous caster for aluminum or the like is made by forming a slurry of refractory fibers in an aqueous solution containing a dispersion of colloidal silica. Liquid is extracted from the slurry to form a flexible felt blanket of refractory fibers which is then compressed in a closed die cavity having the desired geometry of one moiety of the molten metal feed tip. The felt blanket is heated in the closed die cavity to a sufficient temperature to extract water from solution remaining in the blanket to form one rigid moiety of the feed tip. Two such moieties are assembled to form a feed tip having a molten metal feed gap therebetween. The feed tip tapers towards the downstream edges which are compressed to a higher density than the upstream portion of the feed tip. The downstream edges have a greater thermal conductivity than the thermal conductivity of the upstream portion. The inside surfaces of the feed tip can be coated with glass fabric and the outside coated with metal foil to resist moisture. The inside and outside faces have generally planar portions converging from the upstream portion toward the downstream edges.

12 Claims, 5 Drawing Figures

CONTINUOUS CASTER FEED TIP

BACKGROUND

For a number of years continuous casting of aluminum, lead, zinc, and the like has been conducted in commercial scale operations with continuous casters such as shown in U.S. Pat. Nos. 2,790,216 or 4,054,173. These patents are incorporated herein by this reference. Such a continuous caster comprises a pair of rotating water cooled rolls. Molten aluminum, for example, is fed into the nip of the rolls just prior to the line of closest approach of the two rolls. Heat is rapidly extracted from the molten metal by contact with the rolls and freezing occurs before the metal reaches the line of closest approach to the two rolls. In U.S. Pat. No. 4,054,173 substantial hot reduction of the thickness of the resultant aluminum sheet therefore occurs between the rolls for recrystallizing the sheet.

With such a caster aluminum sheets a couple meters wide and about one centimeter thick can be continuously cast at rates of more than a meter per minute for several days at a time. One important aspect of such a continuous caster is the structure for feeding molten metal to the nip of the rolls.

Reasonably satisfactory molten metal feed tips have been made from an insulating composition that is a composite of asbestos fibers and clay particles. Such a material is available from the Johns Manville Company under their trademark Marinite. This material is obtained in flat slabs or planks which are cut and machined to the desired configuration for molten metal feed tips, as well as various launders and other parts of the molten metal handling system.

Although such material is readily formed and resists molten aluminum and the like it has significant shortcomings. One of the more significant problems with such material is the presence of asbestos which is considered carcinogenic. Partial or absolute bans on use of asbestos-containing products have been proposed or are coming into effect. This is a particular problem with such materials for construction of molten metal feed tips for continuous casters since the practice has been to machine the material to the desired geometry. Machining produces many particles which when airborne are extremely hazardous. Expensive dust collection and recovery systems are mandatory for machining the asbestos-containing materials.

Current materials for feed tips are also somewhat fragile and difficulty is encountered with inadvertent breakage. Moisture is quite detrimental to the strength of the composite asbestos-clay material and can exacerbate the breakage problem. Moisture is commonly present in the vicinity of continuous casting machines since the rolls are water cooled, and surface release compounds are sometimes applied to the rolls from aqueous suspensions. In humid environments moisture can condense on the rolls and come in contact with the molten metal feed tips.

A molten metal feed tip made of the asbestos-clay composition can ordinarily be used for only a single run on a continuous caster. Breakage of such feed tips during cleaning and reconditioning for a new run is quite common and such feed tips must be continually replaced.

Further, because of the fragile nature of the material such a feed tip is fabricated to have the maximum thickness of material possible to maximize strength near the thin downstream edges of the tip that fit between the rolls. Thus, as seen in U.S. Pat. No. 4,054,173, the external faces of the continuous caster feed tip are commonly provided with a radius closely paralleling the radius of the rolls of the continuous caster. This can aggravate the problem of moisture contacting the feed tip and can also lead to accumulation of fragments of oxide and other debris between the feed tip and the rolls. Because of the curvature of the faces of the feed tip, the presence of such debris is not easily detected and can result in imperfections in the sheet formed by the continuous caster.

For similar reasons the inside faces of the continuous caster tip are formed with parallel surfaces connected by steep ramps. The width of the gap between the inside faces through which molten metal flows therefore has relatively rapid changes in cross-sectional area. This results in rapid changes in molten metal velocity and the changes in shape of the inside faces can provide locations for temporary accumulations of oxide and other debris which intermittently break loose and cause imperfections in sheet made by the continuous caster.

It is therefore desirable to provide a molten metal feed tip for a continuous caster having improved strength and ease of fabrication. The tip should be free from health hazards of asbestos and relatively insensitive to degradation by moisture. It is desirable for the feed tip to have smooth continuous contours to minimize defects in the sheets made by the continuous caster and avoid discontinuities in the properties of the feed tip. Preferably the molten metal feed tip should be reusable for several runs of the continuous caster.

BRIEF SUMMARY OF THE INVENTION

There is, therefore, provided in practice of this invention according to a presently preferred embodiment a molten metal feed tip for a continuous caster comprising a pair of generally rectangular refractory members spaced apart for forming a metal feeding gap between the members. Each of these members comprises a downstream edge and an upstream portion having a greater thickness than the downstream edge and each is formed of a felt of refractory fibers rigidly bonded together by a refractory binder. The downstream edges of the members are compressed to a higher density and strength than the upstream portion, and have a higher thermal conductivity than the upstream portion.

DRAWINGS

These and other features and advantages of the present invention will be appreciated as the same becomes better understood by reference to the following detailed description when considered in connection with the accompanying drawings wherein.

DESCRIPTION

Figure 1:
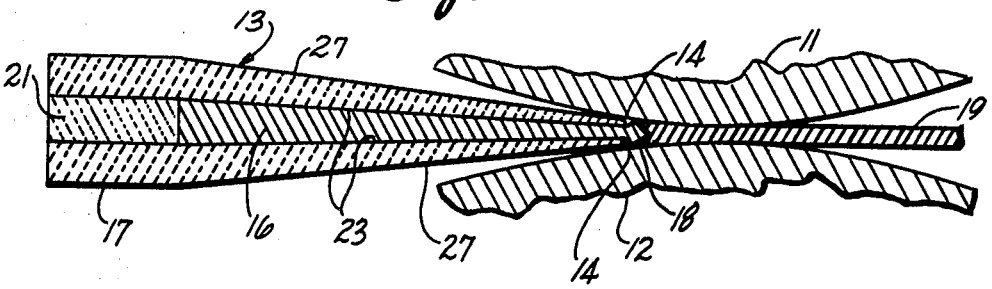
FIG. 1 illustrates in cross section a molten metal feed tip for a continuous caster.

FIG. 1 illustrates in transverse cross section a pair of rolls 11 and 12 of a continuous casting machine. The axes of the two rolls are parallel and they are driven in the direction of movement of metal through the continuous caster (to the right in FIG. 1). A molten metal feed tip 13 has a pair of downstream edges 14 inserted into the narrow gap between the upper and lower rolls. Molten metal 16 is introduced through an upstream portion 17 of the feed tip and flows toward the downstream edges 14. The molten metal emerges from the feed tip and increases in cross section to engage the surface of the rolls. Heat from the molten metal is extracted by the water cooled rolls and freezing occurs in a narrow zone 18 between the rolls and outside the molten metal feed tip. The metal sheet so formed continues through the gap between the slowly rotating rolls and is reduced in thickness to introduce hot working in the metal for refining grain structure. A sheet 19 of solid metal leaves the rolls on the opposite side from the molten metal feed tip.

Although for convenience of illustration the feed tip 13 is shown in a generally horizontal plane with the upper roll 11 directly above the lower roll 12, it will be apparent that the same arrangement is applicable to other orientations. Thus, there are certain advantages in a vertical continuous caster where the axes of the rolls are in a horizontal plane and molten metal is fed upwardly into the gap between the rolls. There are also distinct advantages to an arrangement where the plane of the feed tip is tilted upwardly at about 15° from horizontal so that molten metal feeds upwardly into the gap between the rolls. The molten metal feed tip provided in practice of this invention is suitable for use in any such orientation.

The downstream edges 14 of the feed tip are spaced apart to provide a continuous gap extending along the length of the rolls with the gap having a total length corresponding approximately to the desired width of the sheet being cast. Conventional flaring end dams (not shown) close the ends of the feed tip and help define the width of the sheet being cast. The width of the sheet prepared in a manufacturing operation can differ from time to time and the maximum is dependent on the length of the rolls. A width of 1½ to 2 meters is common. The molten metal feed tip is therefore made in a plurality of segments with each segment typically extending about 15 centimeters along the length of the rolls. Thus, a greater or lesser number of segments can be assembled to form a molten metal feed tip of a desired width for the continuous caster.

Figure 2:
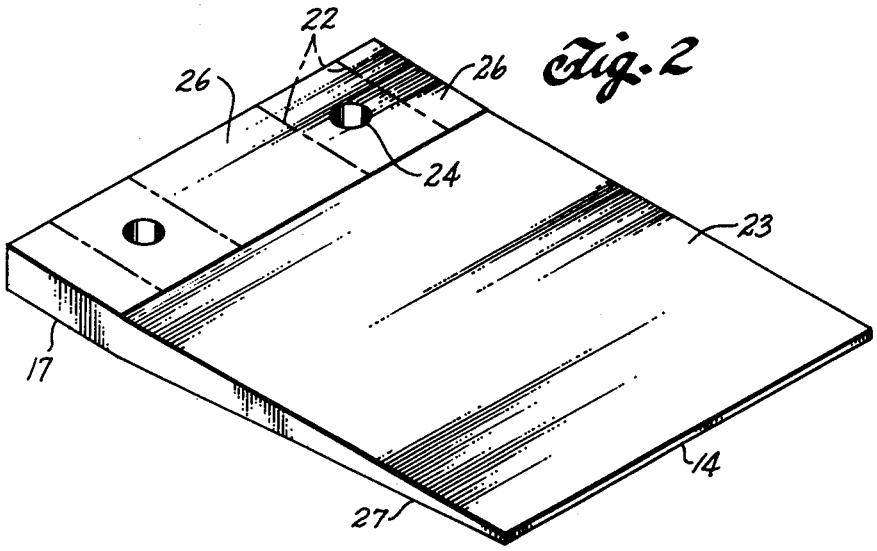
FIG. 2 illustrates in perspective one moiety of such a tip.

One moiety of such a segment is illustrated in perspective in FIG. 2. Each segment of the continuous caster is formed of a pair of similar moieties which are generally rectangular. Spacers 21 are provided between the upstream portions 17 of the two moieties to space them apart and form the metal feeding gap between the inside faces 23 of each half of the feed tip segment. The locations of suitable spacers are indicated in FIG. 2 by the phantom lines 22. The parts of a segment of a molten metal feed tip can be connected together by bolts or the like extending through holes 24 through the two moieties and spacers 21.

If desired instead of the rectangular spacers 21 suggested by the phantom lines 22 in FIG. 2 a streamlined spacer or spacers can be used between the two moieties of the feed tip to further minimize disruptions in the velocity of molten metal flow through the feed tip.

Generally the spacers 21 between the upstream portions of the two halves of the feed tip are sufficient for maintaining a desired gap between the downstream edges 14 of the feed tip. If desired an additional spacer or spacers can be provided at an intermediate location between the upstream portion 17 and the downstream edge 14. Such a spacer, if used, should be reasonably streamlined to avoid disturbance in the metal flow through the feed tip.

The spaces 26 between the spacers 21 provide means for admitting liquid metal to the gap between the two halves of the feed tip. The cross-sectional area for metal flow through the spaces 26 at the upstream portion of the feed tip is preferably greater than the cross-sectional area for metal flow through the gap between the downstream edges 14 of the tip. This assures that metal velocity increases as it flows through the tip instead of decelerating. A substantially straight taper of the gap through which molten metal 16 flows between the upstream portion and the downstream edges is also desirable to minimize abrupt changes in the velocity of metal flowing through the continuous caster tip. Such an arrangement can minimize discontinuities in metal flow and avoid introduction of impurities in sheet formed by the continuous caster. The generally planar inner face also allows the members to be thicker in regions near the downstream edges and enhances strength. This aspect permits the outside face 27 of each moiety to have a generally planar portion adjacent the downstream edge.

The outside faces 27 of the two halves of the feed tip are preferably parallel in the upstream portion for ease of interconnection of the parts to form a segment of the feed tip. Each half of the feed tip has a generally planar portion on the outside face between the downstream edge 14 and the upstream portion, diverging from the central plane of the feed tip towards the upstream portion. A smooth generally linear taper between the upstream portion and the downstream edge is desirable for providing a straight line of sight into the narrow gap between the feed tip and the rolls. This permits visual observation for noting accumulations of foreign matter that could result in imperfections in sheet being made by the continuous caster so that remedial action can be taken. Removal of foreign matter can also prolong the useful lifetime of the feed tip. The straight taper of both inside and outside faces of the feed tip aids in fabrication and provides a continuous progressive change in physical properties of the caster tip as described in greater detail hereinafter; that is, there are no sudden changes in physical or mechanical properties of the feed tip.

The two moieties of the continuous caster feed tip and the spacers therebetween are made of a thermally insulating refractory material which is not wetted by molten aluminum and is resistant to the elevated temperatures encountered in continuous casting. A material that can be processed into a feed tip is described in U.S. Pat. No. 3,092,247 by Richard K. Woodruff and assigned to Refractory Products Company of Dundee, Illinois. Such a material is available from that company under their designation WRP-X-AQ. The patent is incorporated herein by this reference.

The material from which the feed tip is made is a felt of refractory fibers comprising approximately equal quantities of alumina and silica and containing a solution containing colloidal silica. A typical composition of the fibers is about 51.2% alumina, 47.4% silica, and about 0.7% of boron oxide and sodium oxide. A suitable felt is formed from fibers available from the Carborundum Company, Niagara Falls, New York, under their trademark Fiberfrax. The fibers have an average diameter of about 2.5 microns and lengths up to about three centimeters or more.

To make a suitable felt such fibers are dispersed in an aqueous solution containing a dispersion of colloidal silica. A suitable aqueous medium is formed by diluting a composition available from E. I. Du Pont de Nemours and Company of Wilmington, Del. under their trademark Ludox, which contains about 30% by weight of solids of colloidal silica. The colloidal silica has an average particle size of about 17 millimicrons or an average of about 48 silicon atoms per particle. The colloidal silica is stabilized in the solution by sufficient alkali metal hydroxide such as sodium or lithium hydroxide to reach a pH of about 9.5 to 10.5. Such a composition is diluted with water to form a solution containing about 22% by weight solids of colloidal silica. Sufficient refractory fibers are dispersed in the solution to form a slurry having about 5% by weight of fibers.

Such a slurry is formed into a felt blanket or mat of refractory fibers by a conventional felting operation. A porous felting screen is immersed in the slurry and the underside is connected to a vacuum suction. Fibers accumulate on the surface of the screen to form a mat which is preferably up to about 2½ centimeters thick. Suction is maintained on the felt blanket so formed to reduce the liquid content of the mat to about 20% by weight and the colloidal silica content to about 5% by weight. Such a felt blanket formed by vacuum felting from the slurry of refractory fibers is used to form a moiety of the molten metal feed tip for the continuous caster.

To form a feed tip an appropriate size rectangle of such a blanket of refractory felt is cut. For example, to form a segment of a feed tip as illustrated in FIG. 2 a rectangle about 15 centimeters wide and 23 centimeters long is cut from a one inch thick blanket. A glass fabric rectangle the same size as the blanket is smoothed onto one face of the blanket. A suitable fabric is available from Burlington Mills under their designation 3528. Such a fabric has a thread count of 42 by 32 threads per inch and a strand size of about 0.18 millimeters. Preferably the fabric is tightly woven so that there is no open space through the weave. An unsized glass fabric is used on the surface and commercially available glass fabric is preferably cleaned of sizing material before attaching to the felt blanket. Sizing can be removed, for example, by baking the glass fabric at about 250° C. for one-half hour.

A thin sheet of aluminum foil is smoothed over the opposite face of the felt blanket. A foil ¼ to ½ millimeter thick is suitable. A few "weep holes" can be left in the aluminum foil for withdrawing liquid from the blanket.

The refractory felt blanket laminated with glass fabric and aluminum foil is then placed in a die cavity and the cavity is closed by a mating die member. The assembly is then pressed at a pressure insufficient to cause substantial fiber breakage to compress the felt blanket to the desired geometry of one moiety of the continuous caster feed tip as illustrated in FIG. 2. Excess liquid in the closed die is permitted to bleed out through suitable bleed holes in the closed cavity.

When the blanket of refractory fibers is compressed in the closed die cavity it is preferred that the maximum compression in the die be less than about 85% of the original thickness of the vacuum-felted blanket. If the compression is greater than about 85% of the original thickness excessive crushing and breakage of the refractory fibers can occur, resulting in significantly lower strength of the compressed material.

In some embodiments it is desirable to form a continuous caster feed tip having a thickness at the downstream edge of only about 1.85 millimeters. In such an embodiment it is desirable to employ a felted blanket having a tapering thickness. Thus, the thickness of the refractory felt blanket placed in the die cavity is about 1.3 centimeters in the portion corresponding to the downstream edge and the thickness is about 2.5 centimeters in the part corresponding to the upstream portion of the feed tip. Compression of such a tapered blanket yields high density, strength, elastic modulus and thermal conductivity adjacent the downstream edge with lower values of each such property in the upstream portion.

Figure 3:
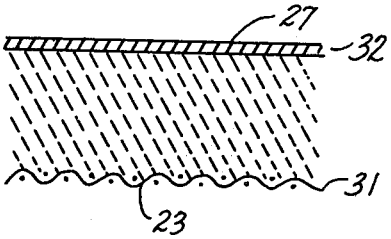
FIG. 3 is a fragmentary transverse cross section of such a moiety of the molten metal feed tip.

After pressing the refractory felt blanket to the desired geometry, the closed die is heated to vaporize water from the solution remaining in the blanket. For example, it is suitable to heat the blanket in the closed die at about 250° to 325° C. for about two hours or about 150° C. for about ten hours. This produces a strong rigid member of refractory fibers bonded together by a binder containing silica. The inside face 23 of this moiety of the molten metal feed tip has the glass fabric 31 (illustrated in FIG. 3 and omitted from FIGS. 1 and 2 for clarity) bonded thereto. The glass fabric is wetted with solution containing stabilized colloidal silica before laminating to the blanket of refractory felt. The outside face 27 has the metal foil 32 (FIG. 3) bonded thereto by a binder containing colloidal silica. The glass fabric on the inside face of the continuous feed tip minimizes erosion of the refractory felt by molten aluminum or the like, thereby minimizing sloughing of particles into the sheet being cast by the continuous caster. The metal foil on the outside face of the feed tip provides a moisture barrier which substantially prevents moisture from contacting the refractory felt during use of the feed tip.

The compression of the refractory felt blanket to form the feed tip appears to result in higher densification of the felt at the surface of the feed tip than in its interior regions. This, plus the reinforcing effect of glass fabric, enhances the strength of the feed tip and minimizes breakage. With such an arrangement four or more uses of a feed tip can be expected from this construction as contrasted with but a single usage of the prior tip constructed of an asbestos clay composition.

The extent of compression of the refractory felt is greater near the downstream edge 14 than it is in the upstream portion 17 of the feed tip. Thus, for example, the downstream edge may have a thickness of about 2.8 millimeters while the upstream portion has a thickness of about 1.6 centimeters. Starting with a 2.5 centimeter thick blanket the downstream edge is compressed about 80% and the upstream portion is compressed about 45%. Since the downstream edge is considerably more compressed than the upstream portion its density is appreciably greater. The upstream portion in one embodiment has a density after hardening of about 0.4 grams/cubic centimeter. The density of the downstream edge is about 0.72 g/cc. Lower amounts of compression can be used where lower mechanical properties are acceptable and lower thermal conductivity is desirable.

The larger compression of the felt blanket in the region of the downstream edges as compared with the upstream portion has a significant effect on the physical properties of the feed tip. The thermal conductivity of the upstream portion is appreciably lower than that of the downstream tip to assure that premature freezing of the molten metal does not occur. The elastic modulus and strength of the downstream edges of the feed tip are substantially enhanced by their greater density. This region is the portion of the feed tip most subject to breakage and the enhanced properties are quite significant in prolonging the lifetime of the tip. The greater strength of the downstream edge portions also resists erosion by molten metal where its velocity is highest.

A tip as hereinabove described has appreciable advantages over that previously formed of an asbestos and clay composition. Prominent of course is the elimination of a health hazard. In addition, however, a feed tip as hereinabove described is roughly twice as strong as that previously used and is essentially unchanged by contact with moisture. Tips made of refractory fiber felt bonded with colloidal silica can be reused in the continuous caster whereas the prior tips containing asbestos could rarely, if ever, be reused.

The method of forming a continuous caster feed tip by compressing the felt of refractory fibers and causing a binder containing colloidal silica to set to form a rigid member permits inclusion of accessory structures which can be useful in continuous casting. Thus, for example, a thermocouple can be embedded in the refractory felt blanket so that the sensing junction is near the downstream edge. Direct measurement of the temperature at the downstream edge can be useful in controlling the operation of the continuous caster.

Although described with respect to a particularly preferred embodiment there can be many variations in the molten metal feed tip for the continuous caster. Thus, for example, the glass fabric and/or metal foil can be deleted from the faces of the feed tip. The compressed and bonded refractory fibers can have adequate strength, erosion resistance and moisture resistance for commercial operations. Degradation of properties of the refractory felt herein described due to water is believed to be negligible.

Figure 4:
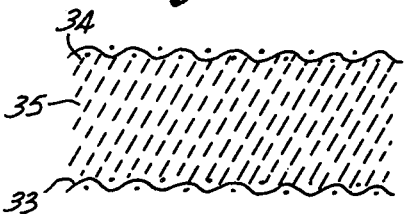
FIG. 4 is a fragmentary transverse cross section of another embodiment of feed tip constructed according to principles of this invention.

If desired an embodiment as illustrated in FIG. 4 can be used. In this embodiment, illustrated in fragmentary cross section, a glass fabric 33 is bonded to the inside face of the refractory felt body 35 as hereinabove described. Another layer of glass fabric 34 is bonded to the outer face of the compressed refractory felt feed tip. The glass fabric layers laminated to the silica bonded refractory fiber felt enhance the flexural and erosion resistance of the feed tip.

Figure 5:
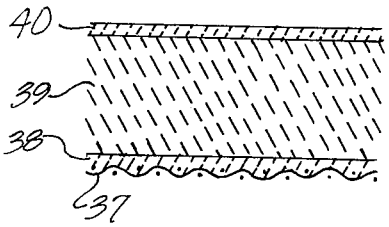
FIG. 5 is a fragmentary transverse cross section of another embodiment of molten metal feed tip.

If desired a feed tip for a continuous caster can be made with laminations for achieving non-homogeneous properties between the inside and outside faces of each of the members. Thus, for example, in one embodiment as illustrated in FIG. 5, a lamination can be made by laying a glass fabric 37 as hereinabove described adjacent the face of the die cavity forming the inside face of one member of the feed tip. Overlying the glass fabric is a layer of paper 38 made from refractory fibers. A suitable paper made from refractory fibers as hereinabove described is available from the Carborundum Company under their designation 970. The paper is made of interfelted fibers similar to the felt of refractory fibers described above, except that the fibers of alumina and silica mixture are somewhat shorter and have been washed to remove glassy beads and the like that are sometimes found in the refractory felt. This lowers the thermal conductivity of the paper relative to a paper without such washing. A suitable paper can be two to three millimeters thick. A refractory felt blanket 39 up to about 2.5 centimeters thick is laid over the refractory paper and a second layer of paper 40 is laid over the refractory blanket.

If desired, a preformed blanket having a tapered thickness so as to be thinner near the downstream edge of the feed tip can be used, or a portion of the fibers along the part to become the downstream edge can be manually removed to avoid excessive compression of the refractory material along the downstream edge of the feed tip. Alternatively the core 39 of the laminate can be made by adding a quantity of bulk fibers to build up a desired thickness remote from the faces of the feed tip moiety. Bulk refractory fibers tangled together in random directions is another product available from the Carborundum Company.

Each of the layers of fabric, paper and felt blanket or bulk fibers is wetted with a binder solution containing colloidal silica stabilized by an alkali metal hydroxide before lamination. When the die is closed, excess solution is squeezed out. After heat curing as hereinabove described such a feed tip has different properties adjacent the inside and outside faces due to the layers of refractory paper sandwiching the blanket of refractory felt. For example, the density of the portion of the felt of fibers corresponding to the layer of paper adjacent the face of the half of the feed tip is higher than the density of the portion remote from the face. If desired a refractory felt paper can be used adjacent one face of the feed tip and the felt of longer fibers used adjacent the other face as well as in a core of the tip.

Although the preferred fibers for the refractory felt comprise a composition with approximately equal proportions of silica and alumina, many other refractory fibers can be employed. Thus, for example, the refractory fibers can include beryllia, zirconia, or higher proportions of alumina. Also, the fiber diameter and length can differ from the embodiment specifically described. Fibers with average diameters of about 4 microns and lengths of 25 centimeters appear satisfactory. The bonding agent for the refractory fibers can have different proportions of colloidal silica and larger or smaller particle sizes. The particle size of the colloidal silica depends on pH of the suspending solution with higher pH resulting in smaller average particle size.

As mentioned above the glass fabric can be deleted from the face of the feed tip. If desired, fabric woven of carbon fibers can be substituted. In some embodiments glass fabric can be stapled directly to the compressed and bonded felt of refractory fibers and retained in place well enough by the molten metal to be serviceable.

Although the outside face of the molten metal feed tip has been described and illustrated with a straight taper between the upstream portion and the downstream edge some variations in this construction are suitable. Thus, for example, rigidifying and strengthening ribs can be formed on the outside face of each moiety of the feed tip. The spaces between such ribs can include additional thermal insulation, if desired. The spacers between the two moieties of the feed tip have been described as separate members. These can be molded integral with one or both moieties of the feed tip with an extra thickness of refractory felt blanket added for the spacer.

Many other modifications and variations of the molten metal feed tip for the continuous caster can be provided by one skilled in the art. It is therefore to be understood that within the scope of the appended claims this invention can be practiced otherwise than as specifically described.

What is claimed is:

1. A molten metal feed tip for a continuous caster comprising:

a pair of generally rectangular refractory members each having a downstream edge portion and an upstream edge portion, each of the members being formed of a felt of refractory fibers rigidly bonded together, the felt of refractory fibers being compressed to a greater density adjacent the downstream edge portions than the upstream portions of said members; and means adjacent the upstream portion for spacing the pair of members apart for forming a metal feeding gap between the members and admitting molten metal into such gap for flow towards the downstream edge portions; and wherein the thermal conductivity of the felt of refractory fibers progressively increases from the upstream portions towards the downstream edge portions.

2. A molten metal feed tip for a continuous caster comprising:

a pair of generally rectangular refractory members each having a downstream edge portion and an upstream edge portion, each of the members being formed of a felt of refractory fibers rigidly bonded together, the felt of refractory fibers being compressed to a greater density adjacent the downstream edge portions than the upstream portions of said members;

a metal foil bonded on at least a portion of the outside face of each member; and means adjacent the upstream portion for spacing the pair of members apart for forming a metal feeding gap between the members and admitting molten metal into such gap for flow towards the downstream edge portions.

3. A molten metal feed tip for a continuous caster comprising:

a pair of generally rectangular refractory members each having a downstream edge portion and an upstream edge portion, each of the members being formed of a felt of refractory fibers rigidly bonded together, the thermal conductivity of the felt of refractory fibers progressively increasing from the upstream portions towards the downstream edge portions; and means adjacent the upstream portion for spacing the pair of members apart for forming a metal feeding gap between the members and admitting molten metal into such gap for flow towards the downstream edge portions.

4. A molten metal tip for a continuous caster comprising:

a pair of generally rectangular refractory members each having a downstream edge portion and an upstream edge portion, each of the members being formed of a felt of refractory fibers rigidly bonded together, the thermal conductivity of the felt of refractory fibers progessively increasing from the upstream portions towards the downstream edge portions;

a metal foil bonded on at least a portion of the outside face of each member; and means adjacent the upstream portion for spacing the pair of members apart for forming a metal feeding gap between the members and admitting molten metal into such gap for flow towards the downstream edge portions.

5. A molten metal feed tip for a continuous caster comprising:

a pair of generally rectangular refractory members each having a downstream edge portion and an upstream edge portion, each of the members being formed of a felt of refractory fibers rigidly bonded with a binder including colloidal silica;

means adjacent the upstream portion for spacing the pair of members apart for forming a metal feeding gap between the members and admitting molten metal into such gap for flow towards the downstream edge portions; and a metal foil bonded on at least a portion of the outside face of each member.

6. A molten metal feed tip as recited in claim 5 further comprising a glass fabric bonded to at least a portion of each member adjacent the metal feeding gap therebetween.

7. A molten metal feed tip as recited in claim 5 wherein the refractory fibers comprise approximately equal proportions of alumina and silica.

8. A molten metal feed tip for a continuous caster comprising:

a pair of refractory members each having a downstream edge portion and an upstream portion having a greater thickness than the downstream edge portion and being formed of a felt of refractory fibers rigidly bonded together, the density and strength of the refractory members continuously increasing from the upsteam portion towards the downstream edge portion; and means at the upstream portion for spacing the pair of members apart for forming a metal feeding gap between the members.

9. A molten metal feed tip as recited in claim 8 wherein the refractory fibers of the felt comprise approximately equal proportions of alumina and silica.

10. A molten metal feed tip as recited in either of claims 8 or 9 wherein the refractory fibers are bonded together by a binder containing colloidal silica.

11. A molten metal feed tip for a continuous caster comprising:

a pair of refractory members each having a downstream edge portion and an upstream portion having a greater thickness than the downstream edge portion, each of the members being formed of a felt of refractory fibers containing approximately equal proportions of alumina and silica rigidly bonded together by a binder formed from a solution containing colloidal silica stabilized with alkali metal hydroxide, the felt of refractory fibers being compressed to a greater density adjacent the downstream edge portion than the upstream portion of such a member whereby the strength and thermal conductivity of the downstream edge portion is greater than the thermal conductivity and strength of the upstream portion;

a metal foil bonded on at least part of one face of each member; and means at the upstream portion for spacing the pair of members apart for forming a metal feeding gap between the members.

12. A molten metal feed tip as recited in claim 11 further comprising a glass fabric bonded to a face of each member adjacent the metal feeding gap.

* * * * *